US006322441B1

(12) United States Patent
Darcey

(10) Patent No.: US 6,322,441 B1
(45) Date of Patent: Nov. 27, 2001

(54) LOUVER MEMBER AND METHOD

(76) Inventor: Mike E. Darcey, 143 Tarleton Ave., Burlington, NC (US) 27215

( * ) Notice: Subject to any disclaimer, the term of this patent is extended or adjusted under 35 U.S.C. 154(b) by 0 days.

(21) Appl. No.: 09/533,193

(22) Filed: Mar. 23, 2000

(51) Int. Cl.[7] ..... F24F 7/00
(52) U.S. Cl. ..... 454/277; 454/280
(58) Field of Search ..... 454/260, 275, 454/276, 277, 280, 281

(56) References Cited

U.S. PATENT DOCUMENTS 140,707 * 7/1873 Hyatt ..... 454/275 X
173,787 * 2/1876 Hayes ..... 454/280
313,865 * 3/1885 Hayes ..... 454/280
345,689 * 7/1886 Hayes ..... 454/275 X
2,803,185 * 8/1957 Coleman ..... 454/280
3,267,834 * 8/1966 Hockett ..... 454/280
3,302,554 * 2/1967 Rousey et al. ..... 454/280
5,070,771 * 12/1991 Mankowski ..... 454/275
5,255,486 * 10/1993 Wang ..... 454/280 X
5,728,000 * 3/1998 Bateman ..... 454/280 X

* cited by examiner

*Primary Examiner*—Harold Joyce

(57) ABSTRACT

A louver member is provided for forming louver assemblies for houses and other buildings for ventilation purposes. The method of installing the louver members includes cutting to size and attaching the same to roof trusses for on-site louver assembly. Each louver member has a somewhat inverted V-shape with a front and an apertured rear to allow air passage.

7 Claims, 10 Drawing Sheets

LOUVER MEMBER AND METHOD

FIELD OF THE INVENTION

The invention herein pertains to louvers for ventilating buildings and particularly pertains to elongated preformed louver members used in on-site louver assembly.

DESCRIPTION OF THE PRIOR ART AND OBJECTIVES OF THE INVENTION

Houses, manufactured homes and other buildings require ventilation to prevent excess heat build-up and deterioration of building structures. Builders of houses and mobile home manufacturers often purchase triangle, octagon, square or other slatted louvers formed from wood, plastic, metal and the like. Openings are then framed on-site and the purchased louvers installed. Such louvers often distract from the appearance of a building or mobile home and are distasteful to homeowners and others. For example, a home which is finished with aluminum siding may have an attic louver formed from wood. The wooden louver is effective for ventilation but unsightly and must be constantly maintained with paint or the like to protect it and prevent it from deteriorating. Oftentimes such louvers in houses are difficult to reach due to their height and are left unattended for many years, ultimately having to be completely replaced.

Thus, with the problems and disadvantages of conventional louvers, the present invention was conceived and one of its objectives is to provide a weatherproof louver member which can be cut to size and installed on-site to form a louver assembly.

It is still another objective of the present invention to provide a louver member and method of use which allows flexibility in the size and shape of the louver assembly formed.

It is also an objective of the present invention to provide louver members which are manufactured for on-site delivery and which can be cut and installed using simple hand tools.

It is yet a further objective of the present invention to provide a louver member which is relatively inexpensive to manufacture and can be self-installed by relatively unskilled workers.

It is a further objective of the present invention to provide a louver assembly which blends with the trim of a house or other building and appears as an integral part thereof.

Various other objectives and advantages of the present invention will become apparent to those skilled in the art as a more detailed description is set forth below.

SUMMARY OF THE INVENTION

The aforesaid and other objectives are realized by providing elongated louver members formed from aluminum or other suitable materials which can be delivered to a job-site, cut to the proper size and easily aligned and installed on a building to form, for example, an attic louver. The louver members have a somewhat inverted V-shape with the front extending outwardly from the rear approximately five centimeters. The rear of the louver member includes a series of apertures which allow air to pass into and out of the building attic. In the preferred form of the louver member a bracket is affixed to the rear which acts as a saddle for alignment and abutment with the adjacent louver member during installation.

The method of installation allows the user to cut a first louver member to a desired length using simple hand tools and thereafter to cut succeeding louver members to successively shorter lengths such as in the construction of a triangular louver assembly. Each individual louver member is then attached to a truss or the like with conventional fasteners to form the louver assembly. When completed the louver assembly is difficult to distinguish from conventional siding and does not detract from the building's appearance.

DETAILED DESCRIPTION OF THE PREFERRED EMBODIMENT AND OPERATION OF THE INVENTION

Figure 1:
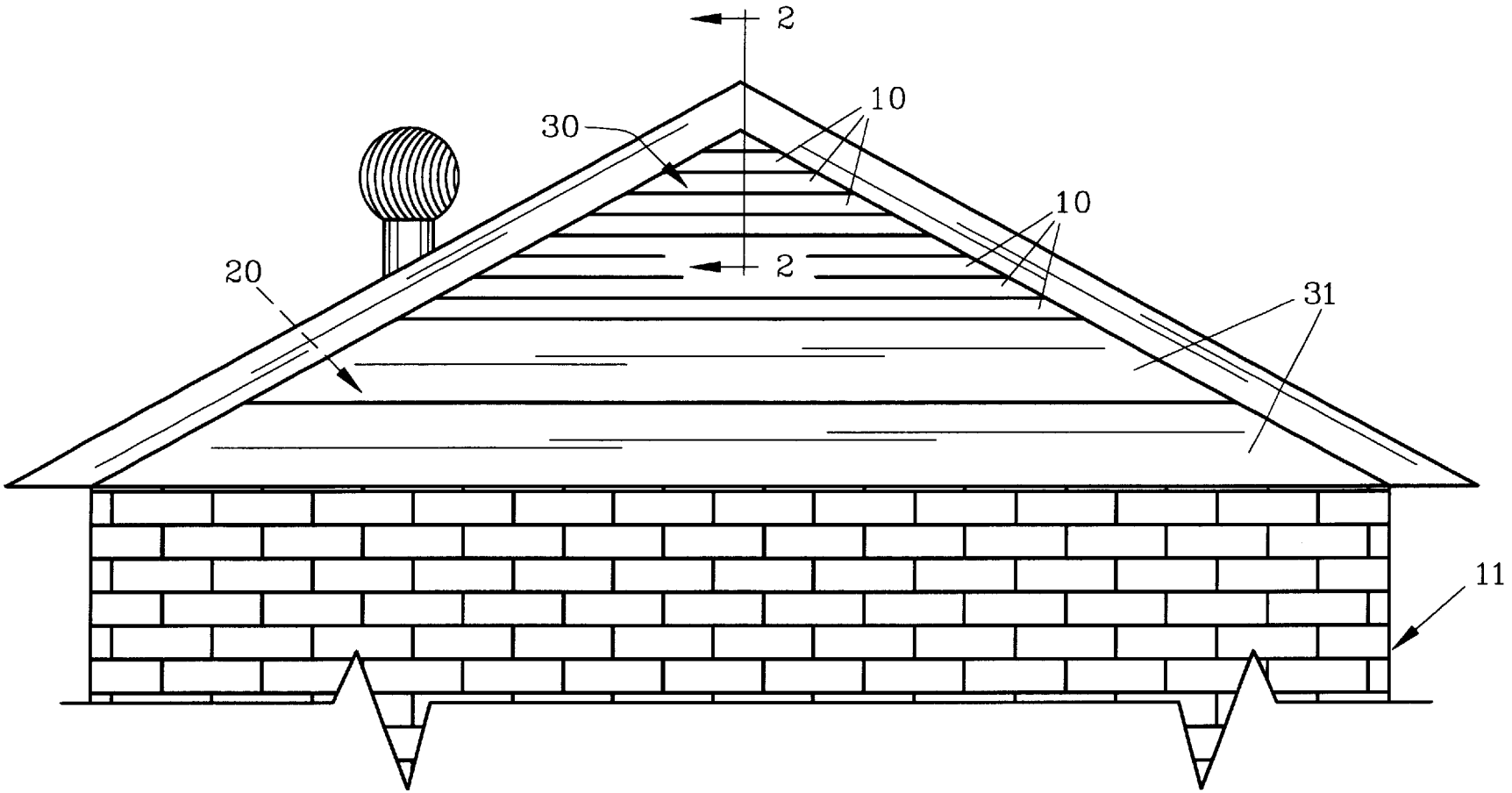
FIG. 1 shows the end of a typical house with the louver members of the invention forming an attic louver assembly.
Figure 2:
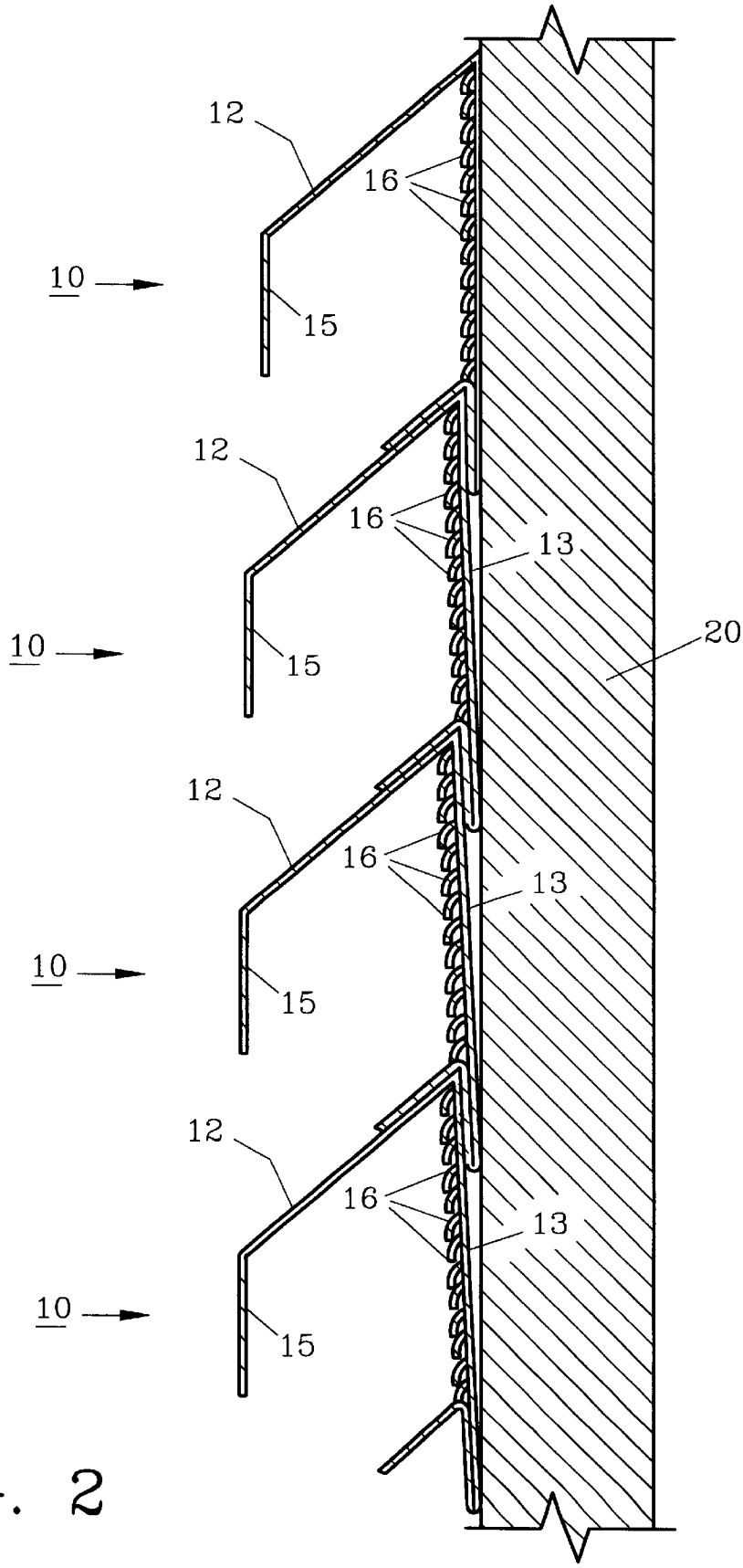
FIG. 2 demonstrates a cross-section view along lines 2—2 of the louver assembly as seen in FIG. 1.

For a more detailed explanation of the invention and its method of use, turning now to the drawings, FIG. 1 demonstrates in schematic form preferred louver members 10 attached to form louver assembly 30 on the end of attic 20 of house 11. Louver members 10 which form louver assembly 30 may be for example, formed preferably such as by extrusion of aluminum in twelve foot (3.66 m) sections for on-site cutting and installation. As seen in FIG. 2, louver members 10 have a general inverted V-shape with an elongated front section 12 and an elongated rear section 13 integrally formed such as by conventional extrusion or molding processes. Front section 12 includes a bent or downwardly directed portion 15 near the distal end thereof. Downward directed portion 15 is parallel to rear section 13. Louver members 10 are attached to supports such as roof truss member 20 such as by nails, staples, screws or otherwise. Truss member 20 is part of a usual roof truss system formed from wooden two-by-fours or other suitable materials.

Figure 3:
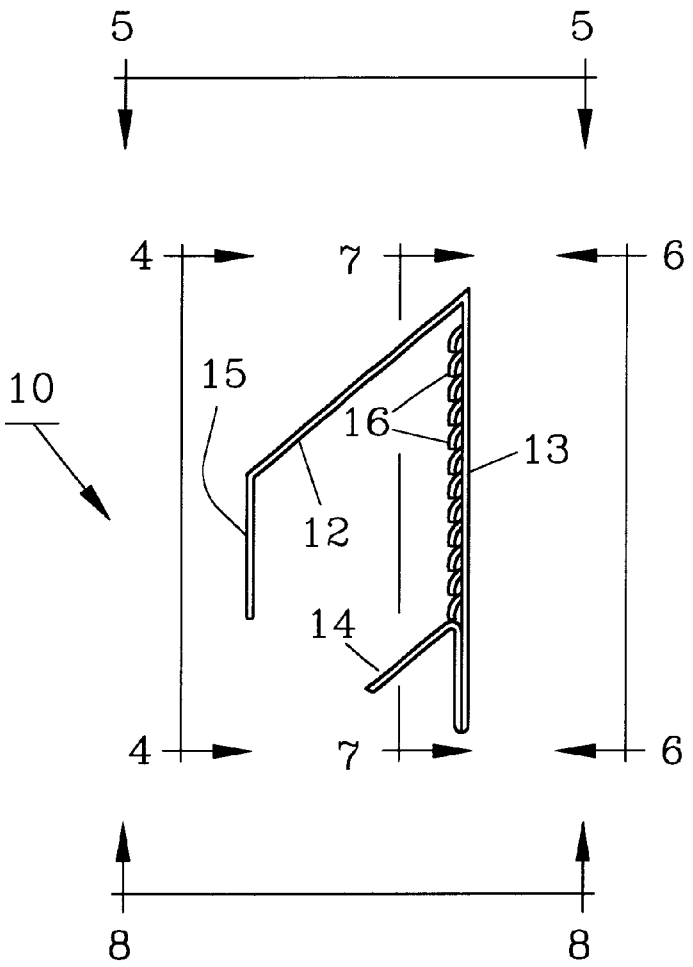
FIG. 3 illustrates an end view of a louver member as shown in FIGS. 1 and 2.
Figure 7:
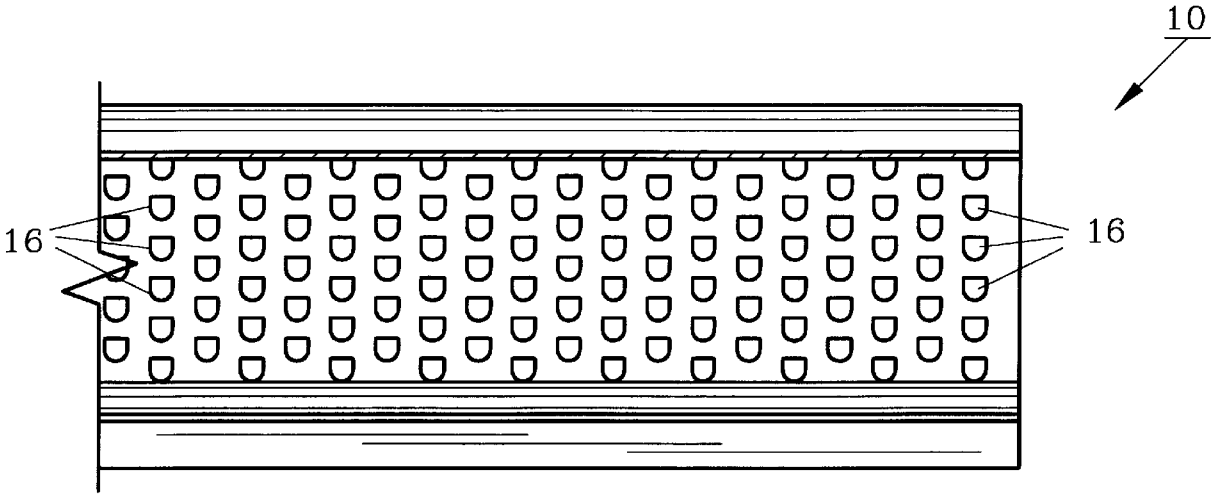
FIG. 7 demonstrates a fragmented front view of the louver assembly as shown in FIG. 3 along lines 7—7.
Figure 8:
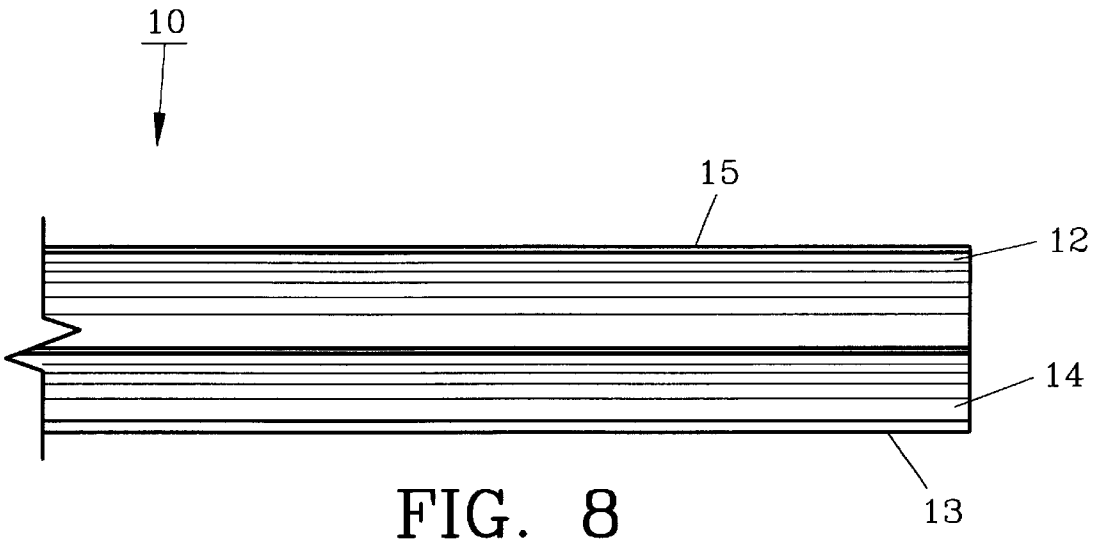
FIG. 8 shows a fragmented bottom view of the louver member as shown in FIG. 3 along lines 8—8.
Figure 6:
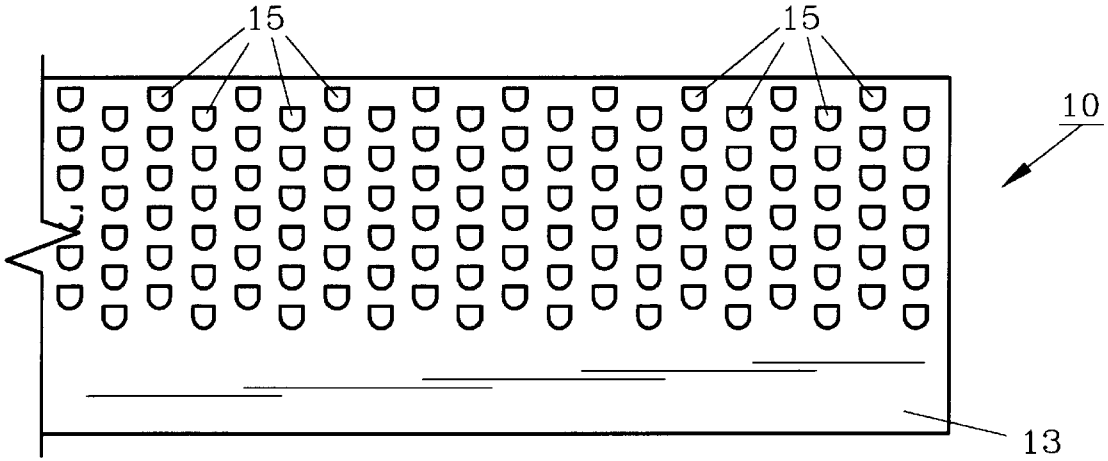
FIG. 6 pictures a fragmented rear view of the louver member as shown in FIG. 3 along the lines 6—6.

In FIG. 3, a single louver member 10 is shown with bracket 14 attached to rear section 13 near the bottom thereof and extending outwardly (FIG. 8), in the same direction as front section 12. Bracket 14 acts as a "saddle" during installation as shown in FIGS. 1 and 2 to allow workmen to easily position adjacent, abutting louver members 10 as seen in FIG. 2 whereby said louver members 10 are aligned parallel. As also shown in FIG. 6, louver member 10 defines a series of apertures 15 in rear section 13 preferably having a "pocket" configuration which can be formed such as by metal stamping or the like. Front lips 16 as shown in FIGS. 7 and 8 are formed during stamping and extend slightly from rear section 13 in a frontal direction. As would be understood, openings 15 allow air to pass from the exterior, into and out of attic 20 of house 11 as shown in FIG. 1.

Louver members 10 are preferably formed from aluminum, although vinyl (polyvinyl chloride) or wood could be used and can be color coordinated to match particular house trim such as siding 31 shown in FIG. 1 or other door and window trim (not shown) as desired. Louver members 10 are manufactured in conventional lengths as are used in the aluminum siding industry.

Figure 4:
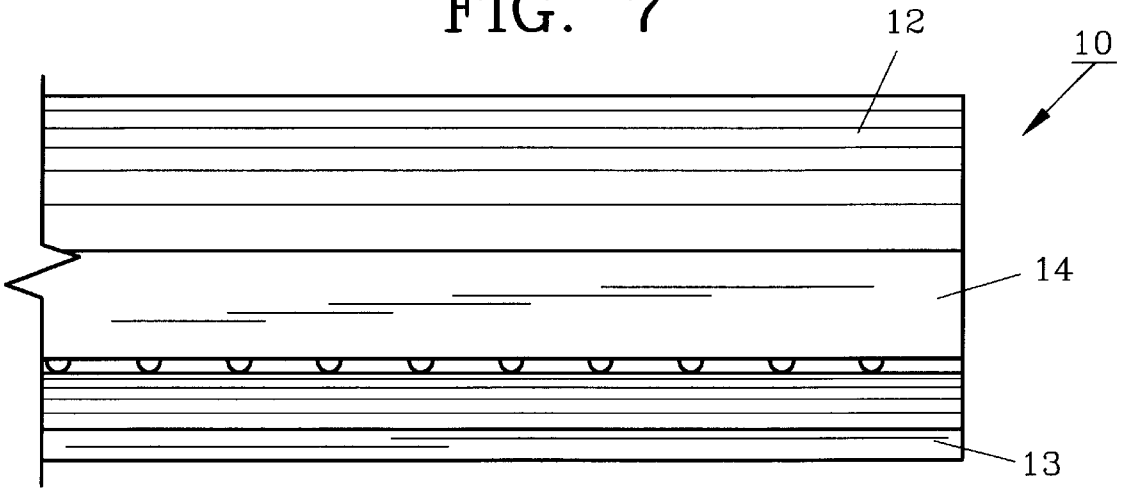
FIG. 4 depicts a front fragmented view of the louver member as shown in FIG. 3 along lines 4—4.
Figure 5:
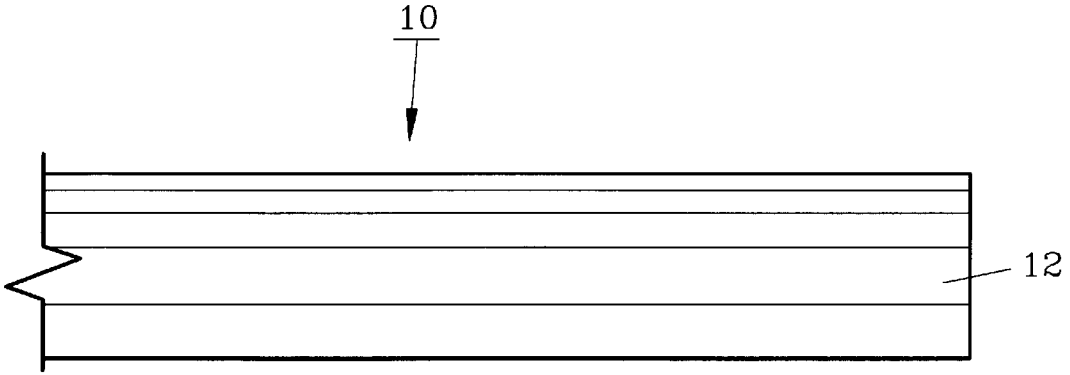
FIG. 5 shows a fragmented top plan view of the louver member as shown in FIG. 3 along lines 5—5.

In FIG. 7, a front view of preferred louver member 10 is shown cut as along lines 7—7 in FIG. 3 whereas in FIG. 4, a complete frontal view as shown along lines 4—4 in FIG. 3 is seen. FIG. 5 is shown along lines 5—5 of FIG. 3 whereas FIG. 8 provides a bottom view thereof. As would be understood, views, 4, 5, 6 and 7 are fragmented for clarity purposes and do not represent a full length of louver member 10.

Figure 9:
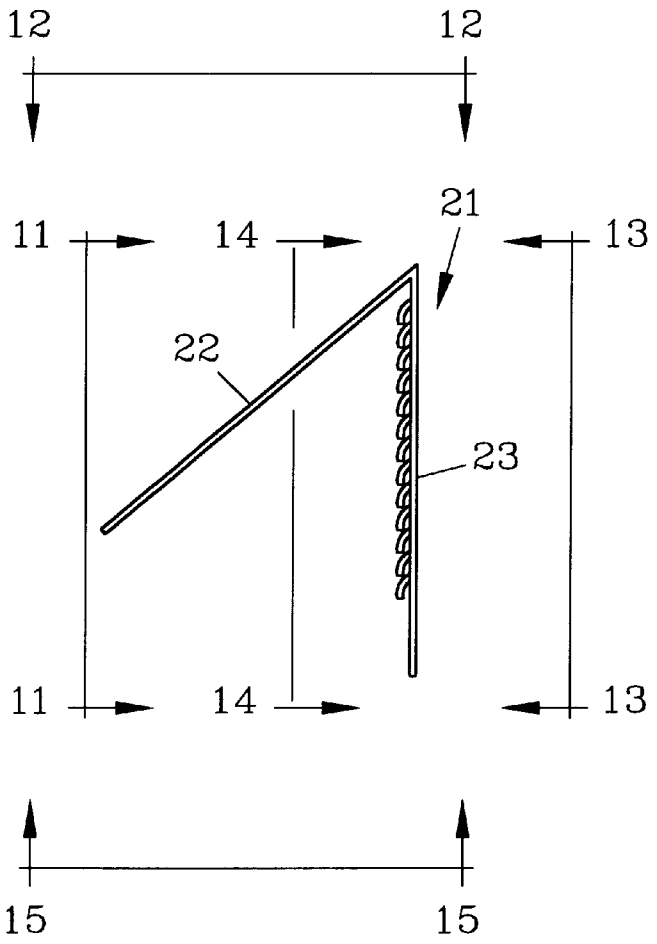
FIG. 9 demonstrates an end view of an alternate embodiment of the louver member.
Figure 10:
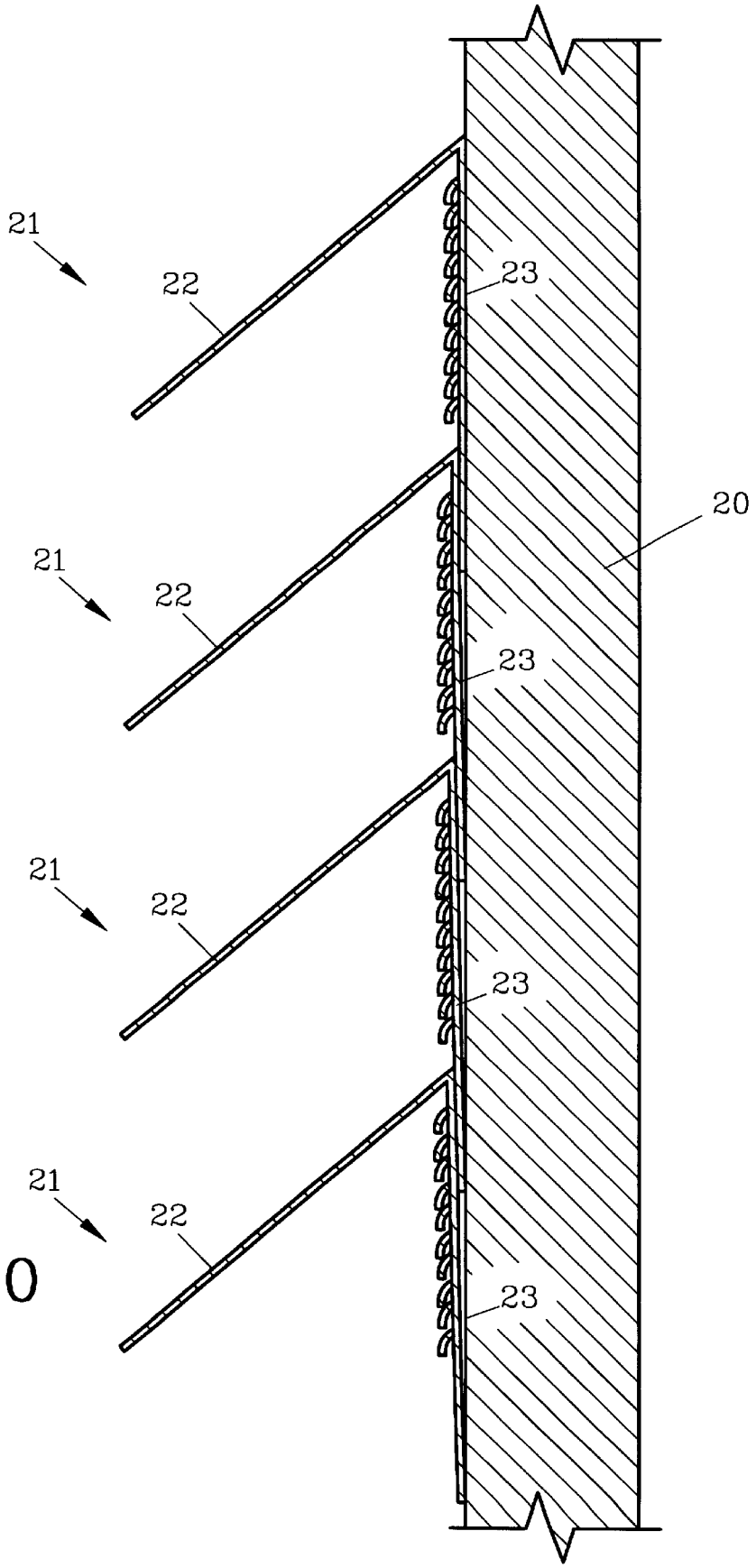
FIG. 10 features a cross-section view of a plurality of the louver members as seen in FIG. 9 forming a louver assembly as in FIG. 1.

An alternate embodiment of a louver member is shown in FIGS. 9–15 wherein louver member 21 is seen with front section 22 and rear section 23. Front section 22 is linear whereas the preferred embodiment as seen in FIG. 3, front section 12 is non-linear. In FIG. 10, louver section 21 is shown attached to roof truss 20. As seen, louver members 21 are slightly overlapped along rear section 23 and are affixed to truss 20 such as by screws,. nails or other conventional fasteners (not shown) as hereinbefore described regarding preferred louver member 10. Air openings 25 are formed in louver section 21 as in preferred louver member 10 by metal stamping or other conventional means. Louver section 21 is less expensive to manufacture due to its simple shape than preferred louver section 10.

Figure 11:
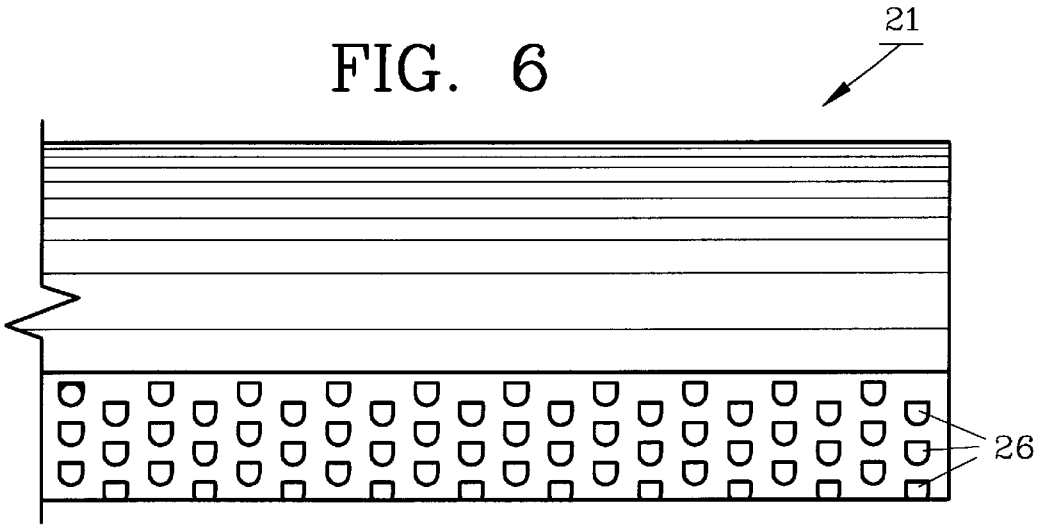
FIG. 11 depicts a fragmented front view of the louver member along lines 11—11 as seen in FIG. 9.
Figure 12:
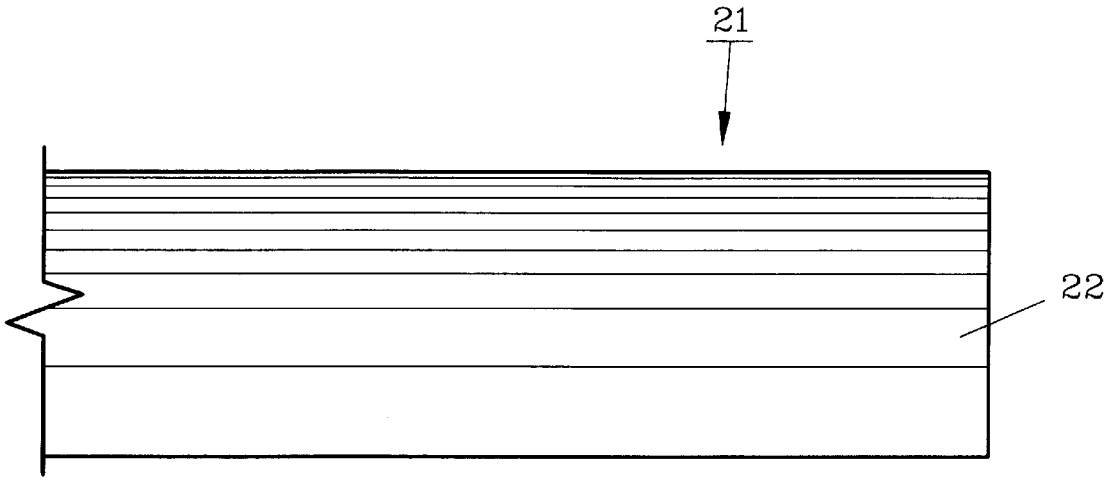
FIG. 12 shows a fragmented top view of the louver member as seen in FIG. 9 along lines 12—12.
Figure 15:
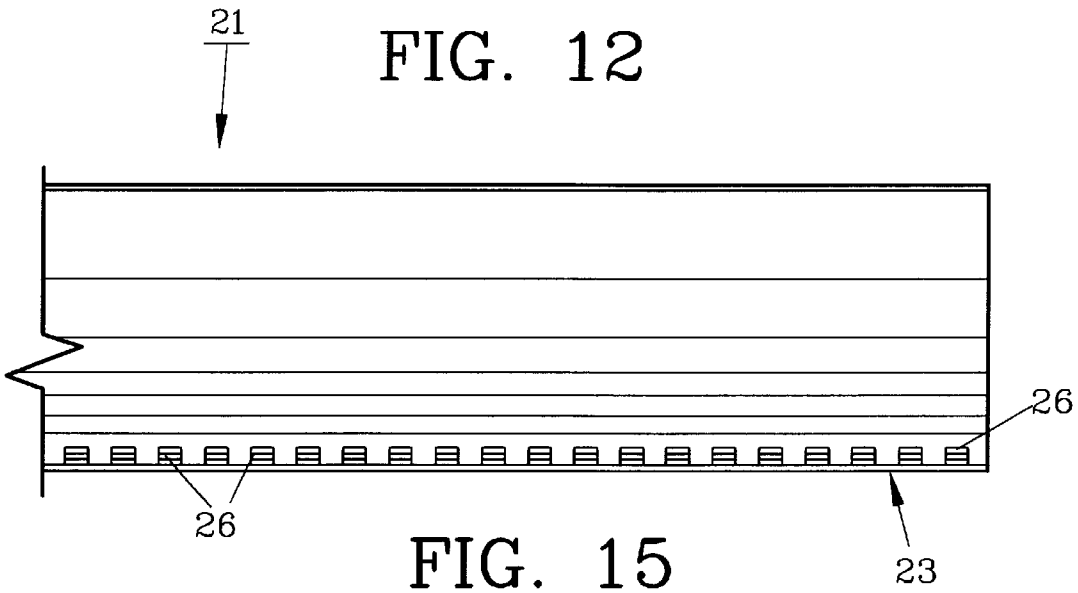
FIG. 15 pictures a fragmented bottom view of the louver member as shown in FIG. 9 along lines 15—15.
Figure 14:
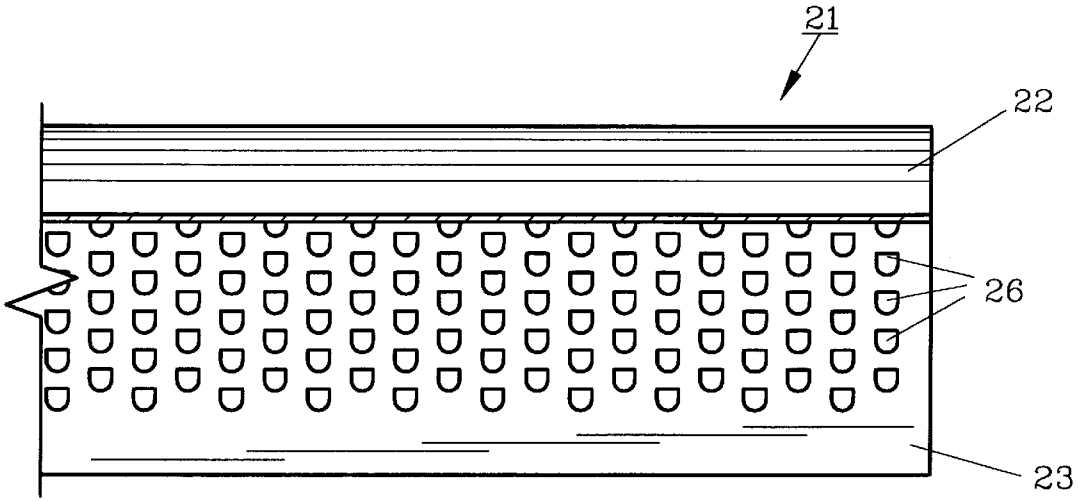
FIG. 14 illustrates a fragmented front view of the louver member as shown in FIG. 9 along lines 14—14.
Figure 13:
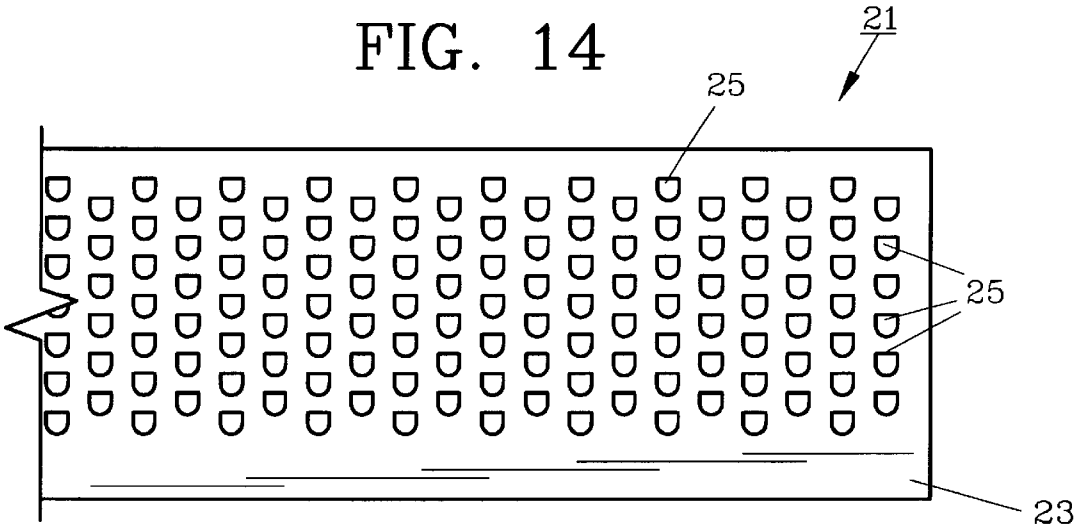
FIG. 13 demonstrates a fragmented rear view of the louver member as shown in FIG. 9 along lines 13—13.

In FIG. 11, as shown along lines 11—11 in FIG. 9, openings 25 are provided with a front lip 26 as also seen in FIG. 14. Rear section 23 as shown in FIG. 13 demonstrates a particular pattern for openings 25 although other patterns and openings may also be utilized, depending on the particular air transfer amount or opening desired. FIG. 12 provides a top view of louver section 21 whereas FIG. 15 provides a bottom view of alternate louver section 21, both as seen in FIG. 9.

The preferred method of applying louver member 10 or louver member 21 to form a louver assembly includes the step of selecting a particular louver member to be utilized and then cutting the member to the desired longest or bottom length as shown in FIG. 1. Next, a second louver member is then cut to the required length to form the next "step" in the triangular shaped louver assembly such as louver assembly 30 as shown in FIG. 1. Once the first cut louvered member is properly attached such as by nails or other fasteners to a roof truss such as truss 20 as shown in FIG. 2, a next or shorter louver member is cut and is then aligned therewith and affixed to the louver member as shown in FIG. 2. Succeeding louver members are cut to the proper length such as with the use of manual tin snips and are likewise affixed to the supporting roof trusses and abutted to the prior louver member until the louver assembly such as triangle-shaped louver assembly 30 is completed and properly installed. When completed, the louver assembly appears unitary and the air openings are substantially concealed from view making the appearance of the building more aesthetically pleasing than with conventional open, slat type louvers.

The illustrations and examples provided herein are for explanatory purposes and are not intended to limit the scope of the appended claims.

I claim:

1. A louver member for ventilation of a building attic comprising: an elongated front section, an elongated rear section, said front section integrally formed to said rear section to form an inverted V-shape when mounted on the building, said rear section defining a plurality of apertures for air passage, and a plurality of lips, said lips positioned over said apertures inside said inverted V-shape.

2. The louver member of claim 1 formed from aluminum.

3. The louver member of claim 1 formed from vinyl.

4. The louver member of claim 1 further comprising a plurality of lips, said lips positioned proximate said apertures.

5. The louver member of claim 1 wherein said front section is linear.

6. The louver member of claim 1 wherein said front section is non-linear.

7. The louver member of claim 1 further comprising a bracket, said bracket affixed to said rear section for receiving an abutting louver member.

* * * * *